United States Patent [19]

Striebel

[11] 3,953,071

[45] Apr. 27, 1976

[54] BACK MOUNTING STRUCTURE FOR A CHAIR

[75] Inventor: Kenneth H. Striebel, Peru, Ind.

[73] Assignee: Kofabco, Inc., Peru, Ind.

[22] Filed: July 11, 1975

[21] Appl. No.: 595,051

[52] U.S. Cl. ..... 297/454; 52/753 R; 52/753 D; 144/313; 297/445; 297/460

[51] Int. Cl.[2] ..... A47C 7/02

[58] Field of Search ..... 297/445, 451, 452, 454, 297/455, 460, 449, 456; 144/313, 318; 52/753 R, 753 C, 753 D, 753.5

[56] References Cited

UNITED STATES PATENTS

| | | | |
|---|---|---|---|
| 352,755 | 11/1886 | Hurley | 297/449 X |
| 2,979,122 | 4/1961 | Knoll | 297/445 |

FOREIGN PATENTS OR APPLICATIONS

| | | | |
|---|---|---|---|
| 268,147 | 5/1963 | Australia | 297/445 |

*Primary Examiner*—James C. Mitchell
*Attorney, Agent, or Firm*—Jenkins, Hanley & Coffey

[57] ABSTRACT

A back mounting structure for a chair having a seat and a contoured back extending generally vertically from a rearward curved edge of the seat is achieved by attaching the back and seat with a plurality of angle brackets, each having a horizontally extending leg and a vertically extending leg. The horizontal legs of the angle brackets are attached to the seat and the vertical legs of the angle brackets are attached to the back. The angle brackets more centrally disposed along the joined edges of the back and seat have their horizontal legs attached to the upper surface of the seat. The angle brackets more outwardly disposed along the joined edges have their horizontal legs attached to the underside of the seat. Forces exerted on the seat back tending to force the central portion of the curvilinear joined edges downwardly and the outward portions of the joined edges upwardly are thus counteracted.

4 Claims, 5 Drawing Figures

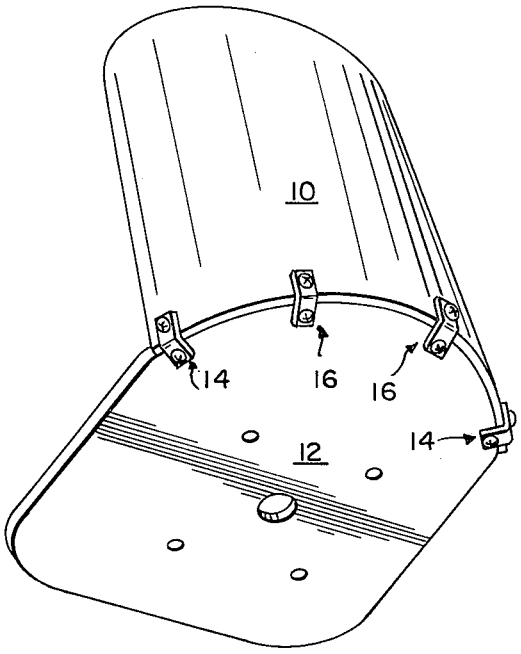
Fig. 1
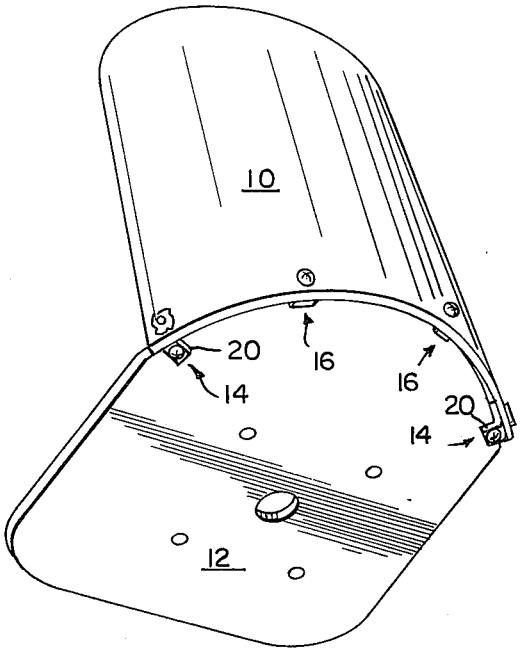
Fig. 2
Fig. 3
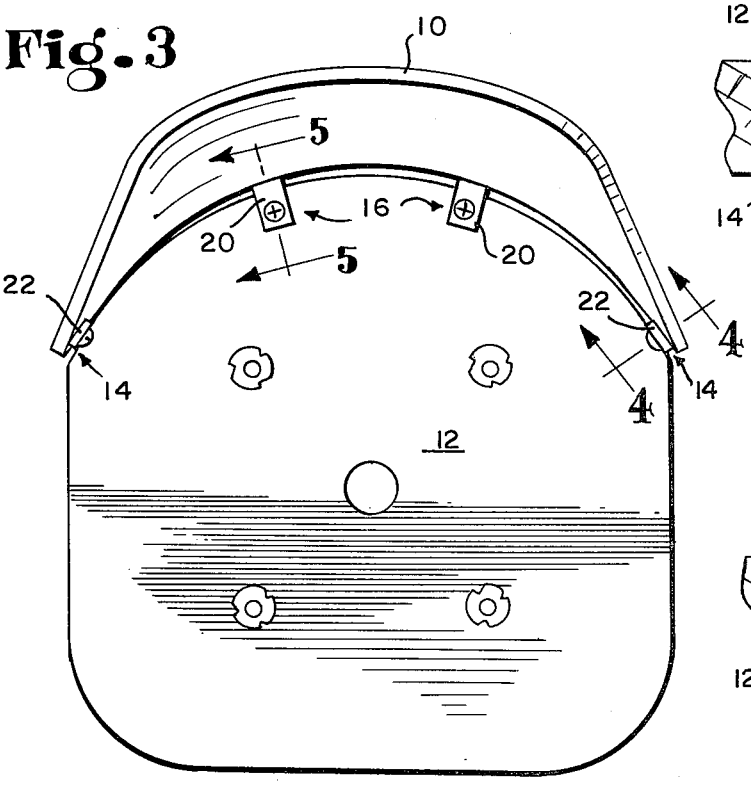
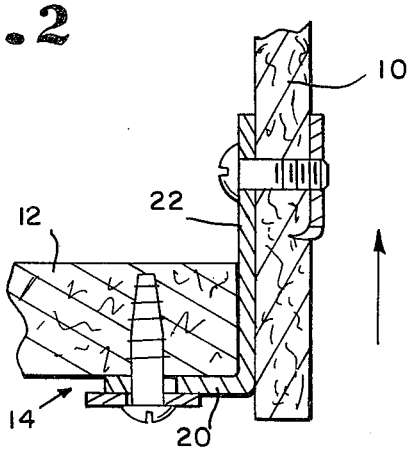
Fig. 4
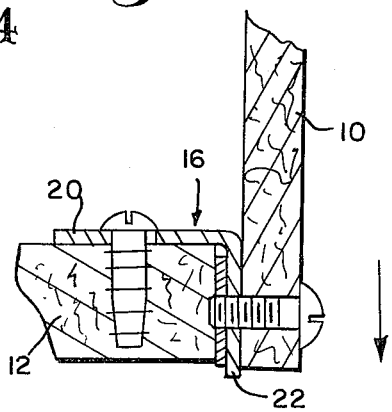
Fig. 5

BACK MOUNTING STRUCTURE FOR A CHAIR

BACKGROUND OF THE INVENTION

This invention deals with an improved structure for chairs.

In a chair having a generally vertically extending back joined to a generally horizontal chair seat along a rearward edge of the seat and a lower edge of the back, the edges may be joined by a plurality of angle brackets. In such a chair construction, the chair back is generally laterally curved to conform to the shape of the human back. Thus the rearward edge of the seat is usually curvilinear to aid in attachment of the back to the seat. The angle brackets used to attach the back and seat together are conventionally attached to the rearward side of the back and the underside of the seat.

When this method of attachment of the back to the seat is employed, however, a problem may arise as the chair is used. Specifically, when excessive force is applied about the line defined by the joined edges of the seat and back, as when an occupant of the chair leans against the back, the angle brackets used to fasten the two together tend to bend. As the force is applied about the joined edges of seat and back, the more centrally disposed portion of the back tends to be forced downwardly and the outwardly disposed portions of the back tend to be forced upwardly. The applied force thus tends to deform the angle brackets. Ultimately, this force may result in the destructive deformation of the brackets.

In accordance with the present invention, a chair comprises a generally horizontal seat and a back extending generally vertically upwardly from a rearward edge thereof and attached thereto by a plurality of angle brackets. The angle brackets which are more centrally disposed along the seat and back adjoining edges have horizontally extending legs attached to the seat on the top surface thereof to minimize downward deformation of the more centrally disposed angle brackets. The angle brackets which are more remotely disposed from the center of the joined edges have horizontally extending legs attached to the seat on the bottom surface thereof to minimize the upwardly directed deformation of the said more remotely disposed angle brackets.

The present invention may best be understood by referring to the following description and accompanying drawings of which:

FIG. 1 is a perspective view of a prior art chair assembly;

FIG. 2 is a perspective view of the chair assembly of the present invention;

FIG. 3 is a top view of the chair of FIG. 2;

FIG. 4 is a sectional view of a detail of the chair of FIG. 3 taken along section lines 4—4 thereof; and, FIG. 5 is a sectional view of a detail of the chair of FIG. 3 taken along section lines 5—5 thereof.

The prior art chair of FIG. 1 illustrates a conventional method of attaching a contoured chair back 10 to the seat 12. Four angle brackets 14,16 have one leg each attached by a screw or bolt to the rearward side of chair back 10, the brackets 16 being centrally disposed and the brackets 14 being outwardly disposed. The other leg of each of brackets 14,16 is attached by a bolt or screw to the underside of seat 12. When the chair is occupied and the occupant leans against back 10, force is applied about the curvilinear joined edges of seat 12 and back 10 causing the central portion of the back to move downwardly and the outer portions to move upwardly. This force tends to cause brackets 14,16 to deform as the legs attached to seat 12 of brackets 16 are forced downwardly and the legs attached to seat 12 of brackets 14 are forced upwardly.

To alleviate this downward deformation of more centrally disposed brackets 16 and upward deformation of more remotely disposed brackets 14, the inventive scheme illustrated in FIGS. 2–5 is presented.

In the inventive scheme, brackets 16 more centrally disposed along the joined edges of back 10 and seat 12 are attached to the top of seat 12 as shown most clearly in FIGS. 3 and 5 which are, respectively, the top view of the chair and a partial sectional veiw of one of centrally disposed brackets 16. This attachment of the legs of brackets 16 to the top of seat 12 helps brackets 16 resist downward deformation due to the forces applied by an occupant of the chair leaning against back 10. Further, as shown most clearly by FIGS. 2 and 4, those brackets 14, more remotely disposed along the adjoining edges of back 10 and seat 12, are attached to the bottom of seat 12 to resist upward deformation of their legs attached to seat 12.

Particularly, each bracket 14,16, has a horizontally extending leg 20 and vertically extending leg 22. In the case of brackets 16, the legs 22 extend downwardly while, in the case of brackets 14, the legs 22 extend upwardly. The legs 20 of brackets 14 are atached to the bottom of seat 12. The legs 20 of brackets 16 are attached to the top of seat 12. The attachment of legs 20 of brackets 16 to the top of seat 12 and the downward extension of legs 22 of brackets 16 between the adjoining edges of seat 12 and back 10 allows brackets 16 to resist the stress applied between seat 12 and back 10 when an occupant leans against back 10 in two ways. First, legs 20 are attached to the top surface of seat 12 and thereby derive additional support from seat 12. Additionally, as a result of legs 22 of brackets 16 being both downwardly disposed and disposed between and adjacent the rearward edge of seat 12 and the front surface of back 10, the stress on legs 22 of angle brackets 16 is tensile and the rearward edge of seat 12 braces leg 22 against twisting deformation. Legs 22 are thus more resistant to deformation by such stress.

Similarly, attachment of legs 20 of angle brackets 14 to the bottom surface of seat 12 lends support to legs 20 to resist upward deformation due to stress between the rearward edge of seat 12 and the front surface of back 10. Further, the upward extension of legs 22 of angle brackets 14 between the rearward edge of seat 12 and the front surface of back 10 additionally braces the legs 22 against twisting deformation.

What is claimed is:

1. In a chair comprising a generally horizontal chair seat having top and bottom surfaces and a rearward curved edge, and a chair back extending generally vertically upwardly from said rearward edge and having forward and rearward surfaces, said back being attached to said seat along said rearward edge of said seat and a lower edge of said forward surface of said back by a plurality of L-shaped angle brackets, each having a vertically extending leg and a horizontally extending leg, some of which angle brackets are centrally disposed and others of which are outwardly disposed along the joined surfaces of said back and seat, the improvement wherein said horizontally extending legs of said brackets more centrally disposed along said joined edges are attached to the upper surface of said seat, and said horizontally extending legs of said more outwardly disposed brackets are attached on the bottom surface of said seat for rendering said brackets more resistant to forces applied along said joined edges.

2. A chair according to claim 1 wherein said vertically extending legs of all of said L-shaped angle brackets are attached to said back on the forward side thereof and extend between said rearward edge of said seat and said forward surface of said back.

3. A chair according to claim 1 wherein said vertically extending legs of said more outwardly disposed angle brackets extend upwardly from said horizontally extending legs thereof and said vertically extending legs of said more centrally disposed angle brackets extend downwardly from said horizontally extending legs thereof.

4. A chair comprising a generally horizontal chair seat portion and a chair back portion extending generally vertically upwardly from the chair seat portion along a generally curvilinear rearward edge thereof and attached thereto by a plurality of angle brackets, each said angle bracket having a generally horizontally extending leg and a generally vertically extending leg, some of said angle brackets being more centrally disposed along the adjoining edges of said seat and back and others of said brackets being more outwardly disposed along said adjoining edges, said horizontally extending legs of said more centrally disposed angle brackets being attached to the seat on the top surface thereof and said vertically extending legs thereof projecting downwardly from said horizontally extending legs between said seat and said back, and said angle brackets more outwardly disposed being attached to the seat on the bottom thereof and said vertically extending legs thereof projecting upwardly from said horizontally extending legs between said seat and said back thereby minimizing the tendency of said angle brackets to deform due to forces applied along said curvilinear joined edges.

* * * * *